US010587067B2

(12) United States Patent
Lager et al.

(10) Patent No.: US 10,587,067 B2
(45) Date of Patent: Mar. 10, 2020

(54) OUTLET SAFETY COVER PLATES

(71) Applicants: Bengt Lager, Kennesaw, GA (US); Jesper Andersen, Ry (DK)

(72) Inventors: Bengt Lager, Kennesaw, GA (US); Jesper Andersen, Ry (DK)

( * ) Notice: Subject to any disclaimer, the term of this patent is extended or adjusted under 35 U.S.C. 154(b) by 0 days.

(21) Appl. No.: 15/824,381

(22) Filed: Nov. 28, 2017

(65) Prior Publication Data

US 2018/0151973 A1 May 31, 2018

Related U.S. Application Data

(60) Provisional application No. 62/426,814, filed on Nov. 28, 2016.

(51) Int. Cl.

| | |
|---|---|
| ***H01R 13/60*** | (2006.01) |
| ***H01R 13/443*** | (2006.01) |
| ***H01R 13/447*** | (2006.01) |
| *H01R 24/76* | (2011.01) |

(52) U.S. Cl.

CPC ..... *H01R 13/443* (2013.01); *H01R 13/447* (2013.01); *H01R 24/76* (2013.01)

(58) Field of Classification Search

CPC .. H01R 13/652; H01R 13/447; H01R 25/006; H01R 23/025; H01R 31/02; H02G 3/14

USPC ..... 439/106, 107, 149, 535, 536, 652, 148; 174/66, 67; 220/241, 242

See application file for complete search history.

(56) References Cited

U.S. PATENT DOCUMENTS

| | | | | | |
|---|---|---|---|---|---|
| 3,989,334 | A * | 11/1976 | Fortino | H01R 13/443 | 439/148 |
| 4,293,173 | A * | 10/1981 | Tricca | H01R 13/443 | 174/67 |
| 4,801,271 | A * | 1/1989 | Piper | H01R 13/443 | 174/67 |
| 5,080,599 | A * | 1/1992 | Wimberly | H01R 13/443 | 174/67 |
| 5,096,430 | A * | 3/1992 | D'Amico | H01R 13/443 | 174/67 |
| 5,106,314 | A * | 4/1992 | Bael | H01R 13/443 | 174/67 |
| 5,308,253 | A * | 5/1994 | Maki | H01R 13/443 | 248/205.3 |
| 5,320,543 | A * | 6/1994 | Barton | H01R 13/443 | 439/148 |
| 5,375,728 | A * | 12/1994 | West | H01R 13/443 | 174/488 |

(Continued)

*Primary Examiner* — Thanh Tam T Le

(74) *Attorney, Agent, or Firm* — Thomas Horstemeyer, LLP

(57) ABSTRACT

Various examples are provided for outlet safety cover plates. In one example, an outlet safety cover plate includes a cover having a front face and a rear side; a first pair of prongs extending from the rear side of the cover, the first pair of prongs configured to fit into a first pair of contact openings in an electrical outlet; and a second pair of prongs extending from the rear side of the cover, the second pair of prongs aligned with the first pair of prongs and configured to fit into a second pair of contact openings in an electrical outlet, where a width of the first pair of prongs is approximately two thirds of a width of the second pair of prongs. In another example, an outlet safety cover plate includes first and second covers that align with each other when inserted in an electrical outlet.

18 Claims, 11 Drawing Sheets

(56) References Cited

U.S. PATENT DOCUMENTS

| | | | | | |
|---|---|---|---|---|---|
| 5,691,507 | A * | 11/1997 | Wei | H01R 13/447 | 174/67 |
| 5,723,816 | A * | 3/1998 | Neece | H02G 3/14 | 174/66 |
| 6,664,471 | B1 * | 12/2003 | Howe, Jr. | H02G 3/14 | 174/66 |
| 6,674,003 | B1 * | 1/2004 | Torres | H02G 3/14 | 174/66 |
| 6,703,562 | B1 * | 3/2004 | Pacheco | H02G 3/14 | 174/66 |
| 6,897,381 | B2 * | 5/2005 | He | A01M 1/2072 | 174/66 |
| 7,070,426 | B2 * | 7/2006 | DeCell, Jr. | H01R 13/443 | 439/135 |
| 7,119,278 | B1 * | 10/2006 | Shotey | H02G 3/14 | 174/66 |
| 7,633,009 | B1 * | 12/2009 | Baldwin | H02G 3/14 | 174/66 |
| 7,652,210 | B2 * | 1/2010 | White | H01R 13/447 | 174/53 |
| 7,950,934 | B2 * | 5/2011 | Sallam | H01R 13/4534 | 220/241 |
| 8,093,497 | B2 * | 1/2012 | White | H02G 3/14 | 174/66 |
| 8,287,305 | B2 * | 10/2012 | Sil | H01R 13/443 | 439/535 |
| 8,834,210 | B2 * | 9/2014 | Brausen | H01R 31/065 | 439/718 |
| D755,607 | S * | 5/2016 | Baber | D8/353 | |
| 9,461,419 | B2 * | 10/2016 | Hector, Jr. | H01R 25/003 | |
| 9,509,080 | B1 * | 11/2016 | Insalaco | H01R 24/30 | |

* cited by examiner

Reading = 32.31 mm

Reading = 30.62 mm

Reading = 34.28 mm

Reading = 32.62 mm

OUTLET SAFETY COVER PLATES

CROSS REFERENCE TO RELATED APPLICATIONS

This application claims priority to, and the benefit of, U.S. provisional application entitled "Outlet Safety Cover Plate" having Ser. No. 62/426,814, filed Nov. 28, 2016, which is hereby incorporated by reference in its entirety.

BACKGROUND

Unused electrical outlets are unsightly and are an unsafe, unattractive nuisance. Homes and commercial buildings have many more electrical outlets than are needed at any one time because current building codes in the United States require that there be no longer than a six foot floor run to an available electrical outlet. Consequently, contemporary homes and commercial buildings and older homes and commercial buildings that are remodeled and meet current building codes have many excess electrical outlets. These unused electrical outlets distract from the decor of a room and provide increased opportunities for the occupants of a room to come in contact with electrical hazards.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
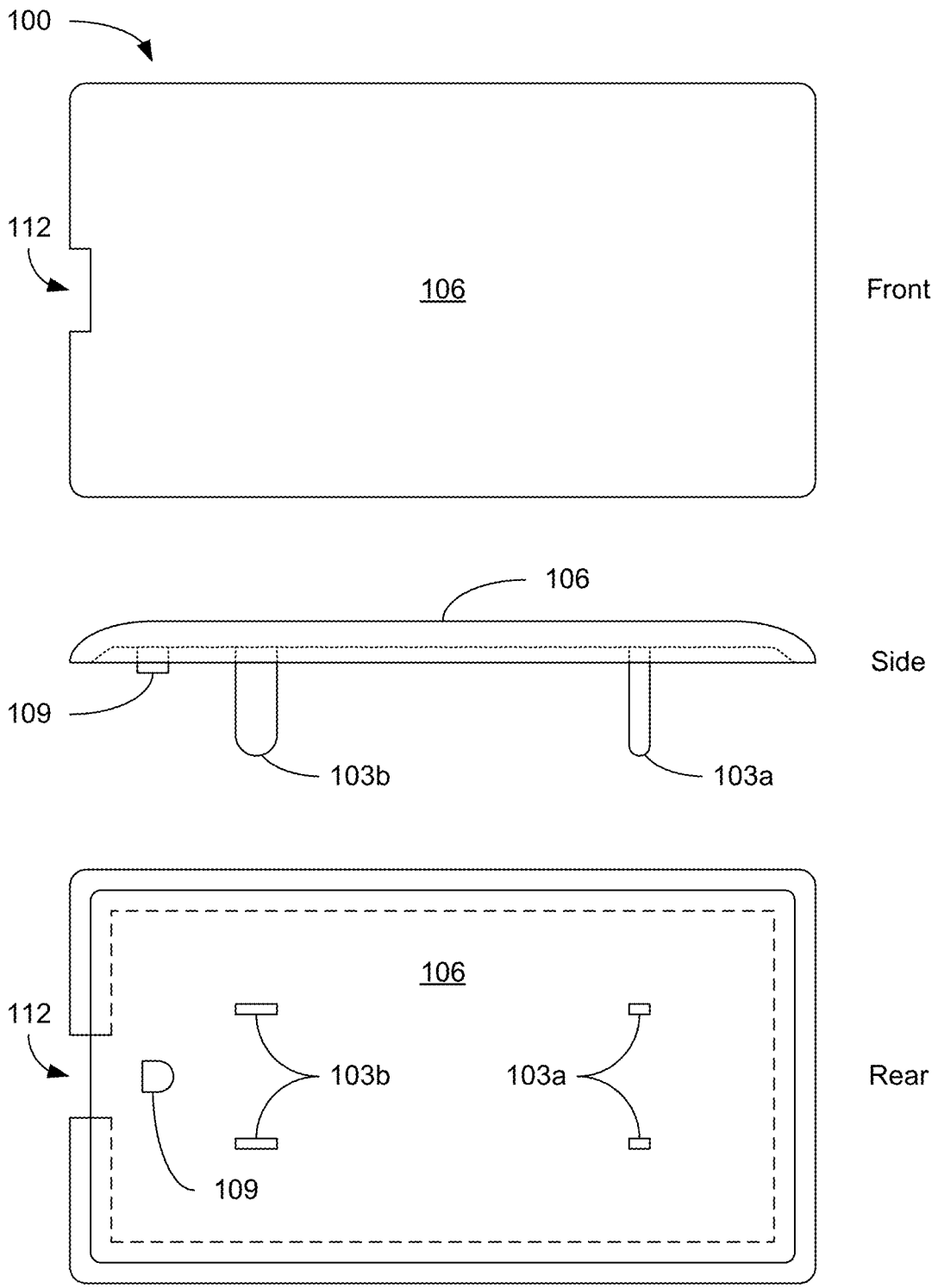
FIG. 1 illustrates top, side and bottom views of an example of an outlet safety cover plate, in accordance with various embodiments of the present disclosure.

Disclosed herein are various embodiments related to outlet safety cover plates. Reference will now be made in detail to the description of the embodiments as illustrated in the drawings, wherein like reference numbers indicate like parts throughout the several views.

Electrical outlets are typically placed throughout a home or business for ready access to electrical power, and the electrical outlets are usually covered with a conventional wall plate. Many times, these electrical outlets are positioned where children can easily reach them. A child may insert an electrically conductive object or a finger into such an electrical outlet, resulting in an electric shock.

This disclosure presents examples of electrical outlet safety cover plates that are safe, removable, and able to fit multiple outlet configurations. The outlet safety cover plates can be used to cover outlets in older homes that may not be up to today's electrical codes, thus improving the safety of the home. The electrical outlet covers can also prevent children or pets from accessing any part of the wall outlet. The electrical outlet cover may be formed with at least one row of perforation so as to be easily adapted to allow a user to manually tear, snap, break, or otherwise rend the configurable electrical outlet cover into at least two separate pieces without the need for a separate tool, such as a scissors or the like. The electrical outlet cover can comprise units that can cover a single socket of a wall outlet, or can be matched to cover a pair of sockets. As a result, the electrical outlet cover plate can cover a portion of the electrical outlet wall plate, such that the outer edges of the electrical outlet wall plate.

Referring now to FIG. 1, an outlet safety cover plate 100 can include two pairs of prongs 103 disposed on a rear side of a cover 106 of the outlet safety cover plate 100, that are sized and spaced to engage electrical contact openings of conventional and GFCI outlets. Spacing of the contact openings of the two types of outlets are different. Because of this, the two pairs of prongs can be positioned and sized to allow them to be inserted into the corresponding contact openings of either the conventional outlet or the GFCI outlet without adjustment or modification. A first pair of prongs 103*a* can be located on an upper portion of the rear side of the cover 106 and a second pair of prongs 103*b* can be located on a lower portion of the rear side of the cover 106. In addition, a ground alignment post 109 can be located between the second pair of prongs 103*b* and the bottom edge of the cover 106, and can be approximately aligned with a center point between the prongs of the second pair of prongs 103*b* or approximately centered between opposite sides of the cover 106. The shape of the ground alignment post 109 corresponds to the shape of a grounding contact opening in the electrical outlet. When inserted into an electrical outlet, the ground alignment post 109 engages with the grounding contact opening to align and secure the outlet safety cover plate 100 in position.

Figure 2A:
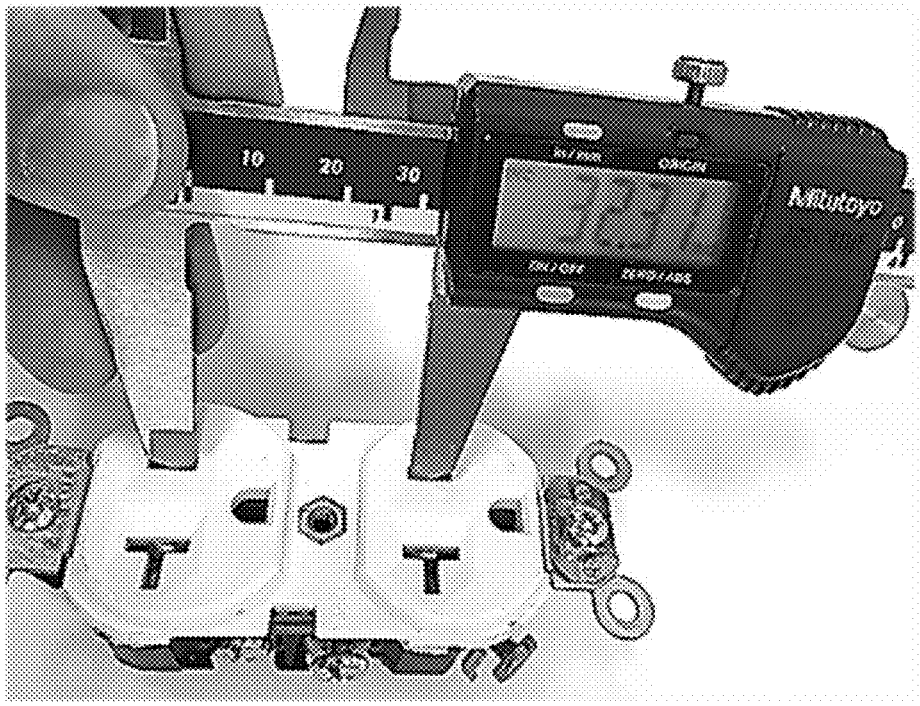
FIGS. 2A through 2C are images illustrating differences in electrical outlet dimensions, in accordance with various embodiments of the present disclosure.
Figure 2A:
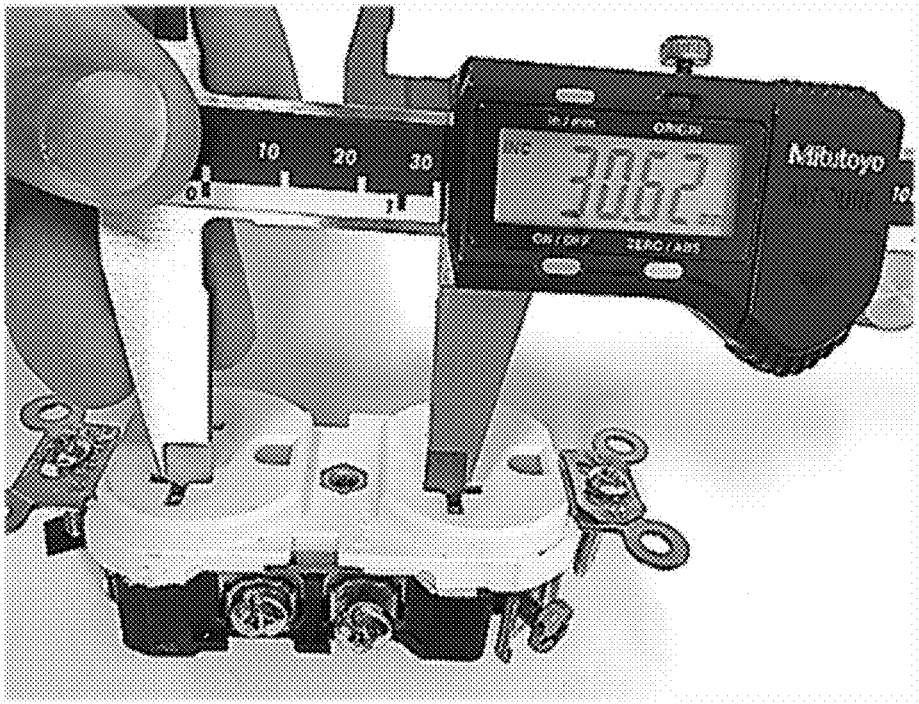
Figure 2B:
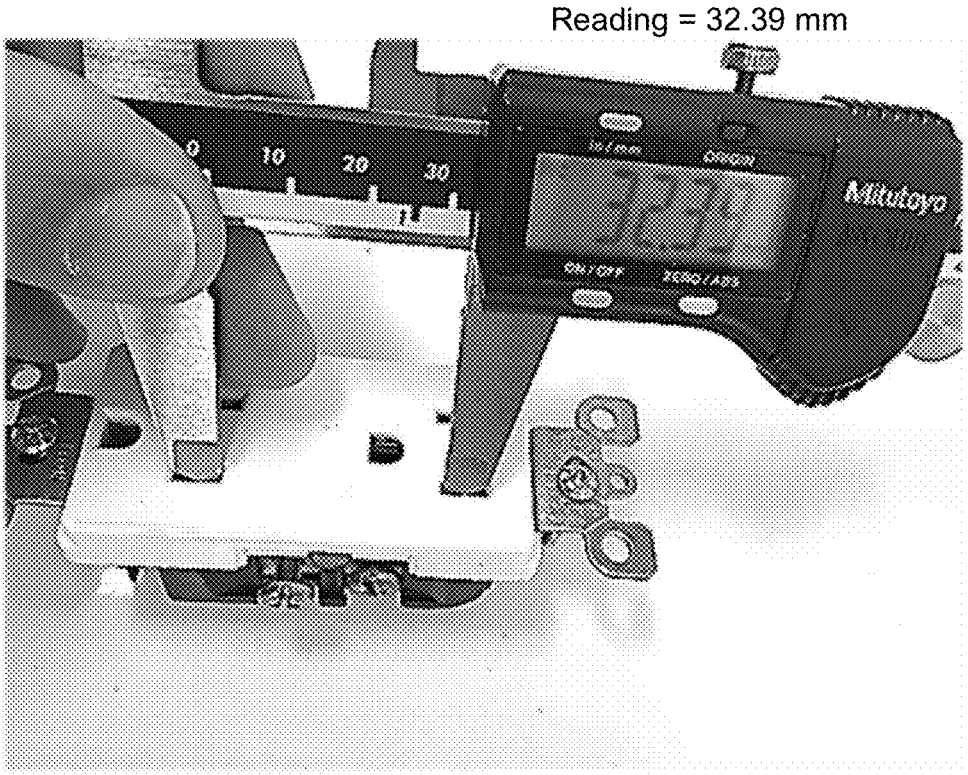
Figure 2B:
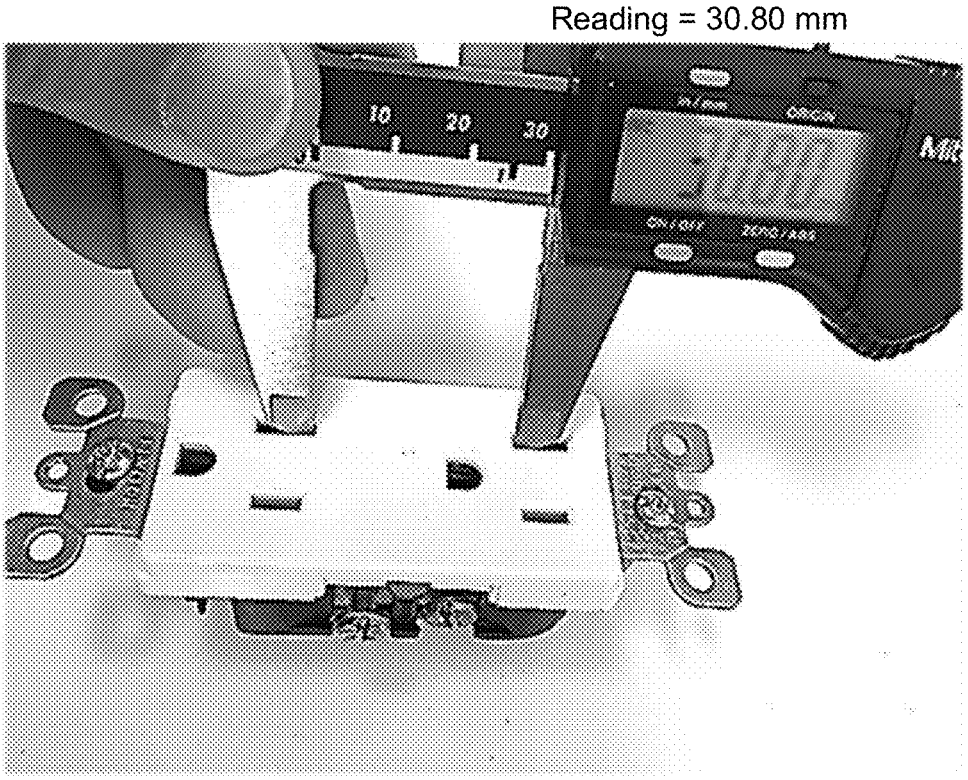
Figure 2C:
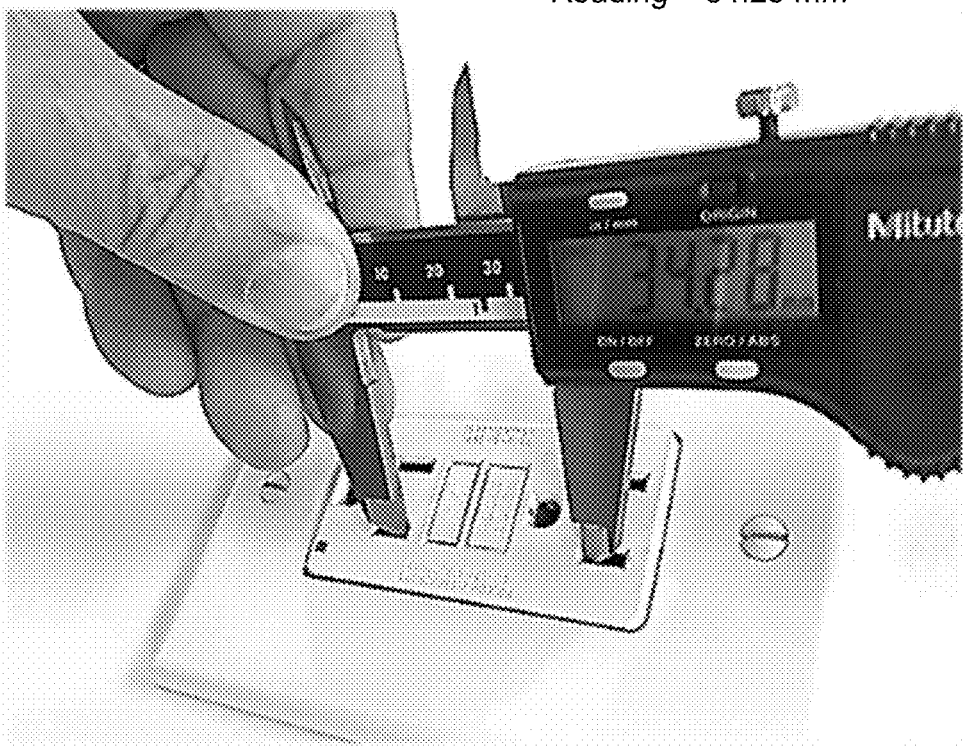
Figure 2C:
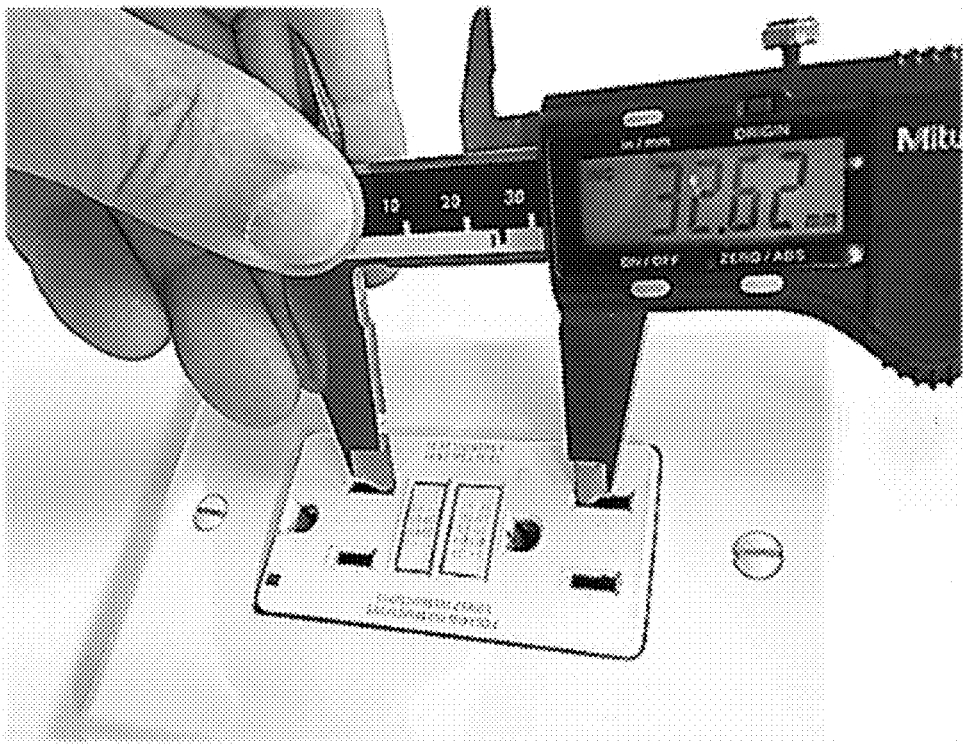

Referring next to FIGS. 2A, 2B and 2C, shown are images illustrating an example of the differences in the spacing between the first and second pairs of electrical contact openings in conventional duplex outlets, rectangular outlets, and GFCI outlets, respectively. As can be seen, the distances between the pairs of electrical contact openings vary depending on the configuration of the electrical outlet. The prongs 103 allow the outlet safety cover plate 100 to fit over the electrical outlet without requiring the user to remove the electrical wall plate from the electrical outlet box inside the wall. The size differences and arrangement of the pairs of prongs 103 on the cover 106 of the outlet safety cover plate 100 allow the outlet safety cover plate 100 to fit a variety of outlet configurations. The prongs 103 are typically made of the same material as the cover 106 and are typically made integral therewith.

Figure 3A:
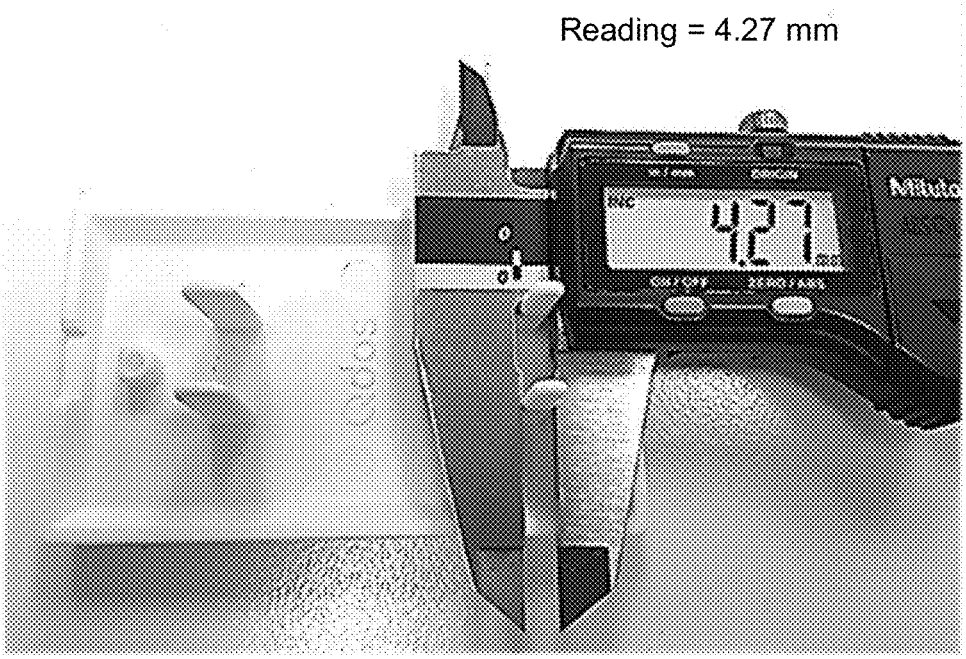
FIGS. 3A and 3B are images illustrating an example of the width of the first pair and second pair of prongs of the outlet safety cover plate of FIG. 1, in accordance with various embodiments of the present disclosure.
Figure 3B:
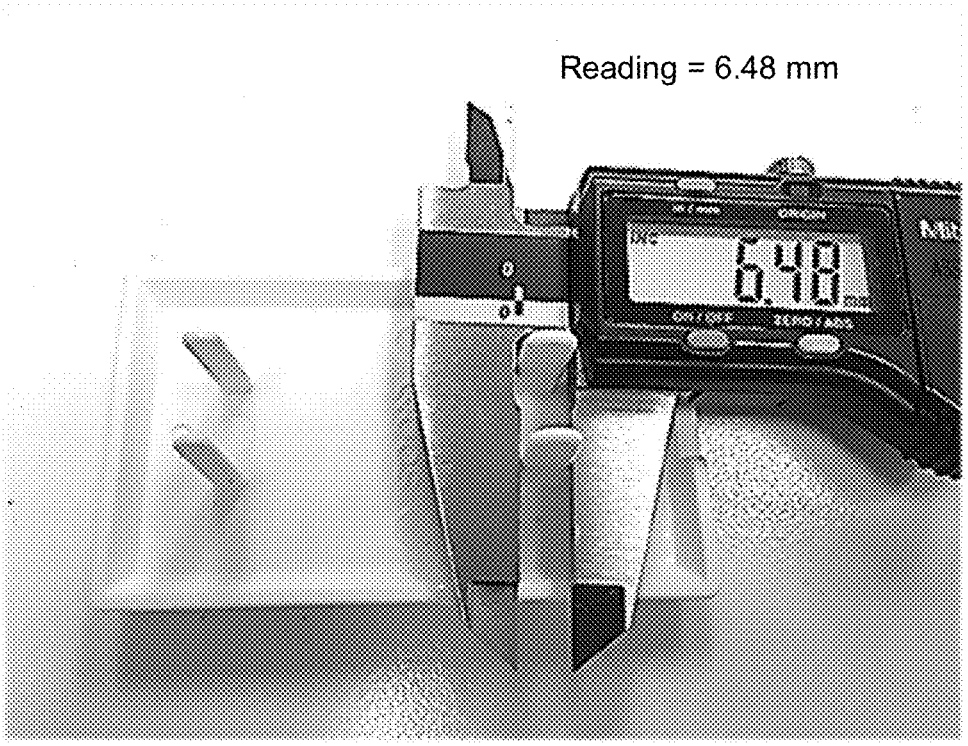

FIGS. 3A-3E are images illustrating an example of the size and separation between the prongs 103. The width of the first pair of prongs 103*a* is approximately two thirds of the width of the second pair of prongs 103*b*. For example, the width of the first pair of prongs 103*a* can be in a range from about 4.2 mm to about 4.4 mm, or from about 4.2 mm to about 4.35 mm, and the width of the second pair of prongs 103*b* can be in a range from about 6.3 mm to about 6.6 mm, or from about 6.4 mm to about 6.55 mm. In FIG. 3A the width of the first pair of prongs 103*a* is about 4.3 mm and in FIG. 3B the width of the second pair of prongs 103*b* is about 6.5 mm. The length and thickness of the prongs 103 are sufficient to allow the contacts inside the contact openings to engage with the sides of the prongs 103, which holds the outlet safety cover plate 100 in position over the electrical outlet.

Figure 3C:
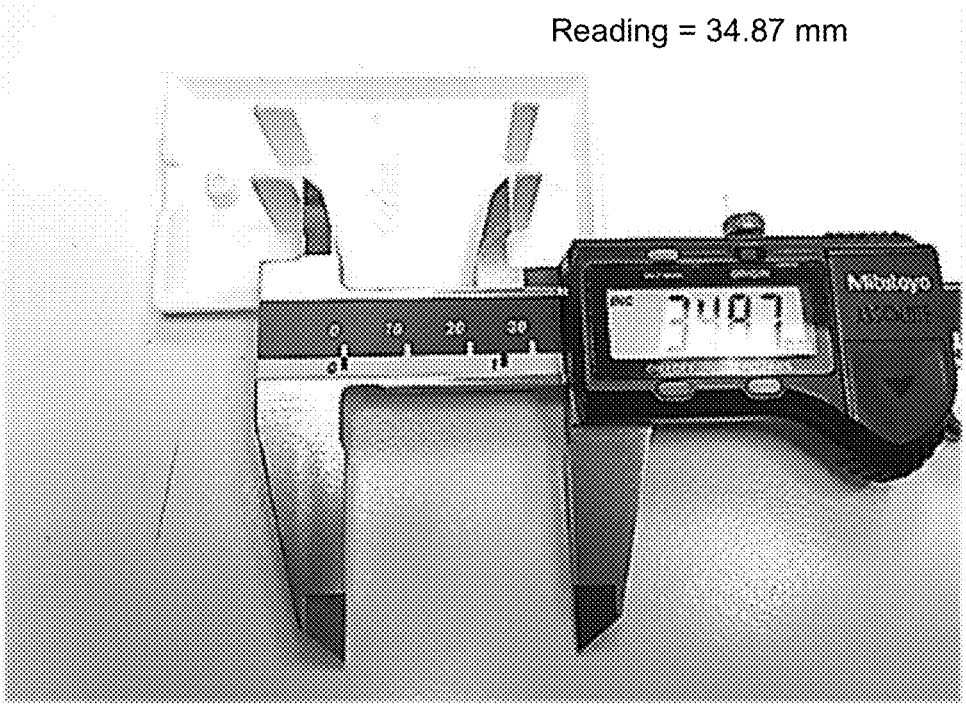
FIGS. 3C through 3E are images illustrating an example of the separation between prongs of the outlet safety cover plate of FIG. 1, in accordance with various embodiments of the present disclosure.
Figure 3D:
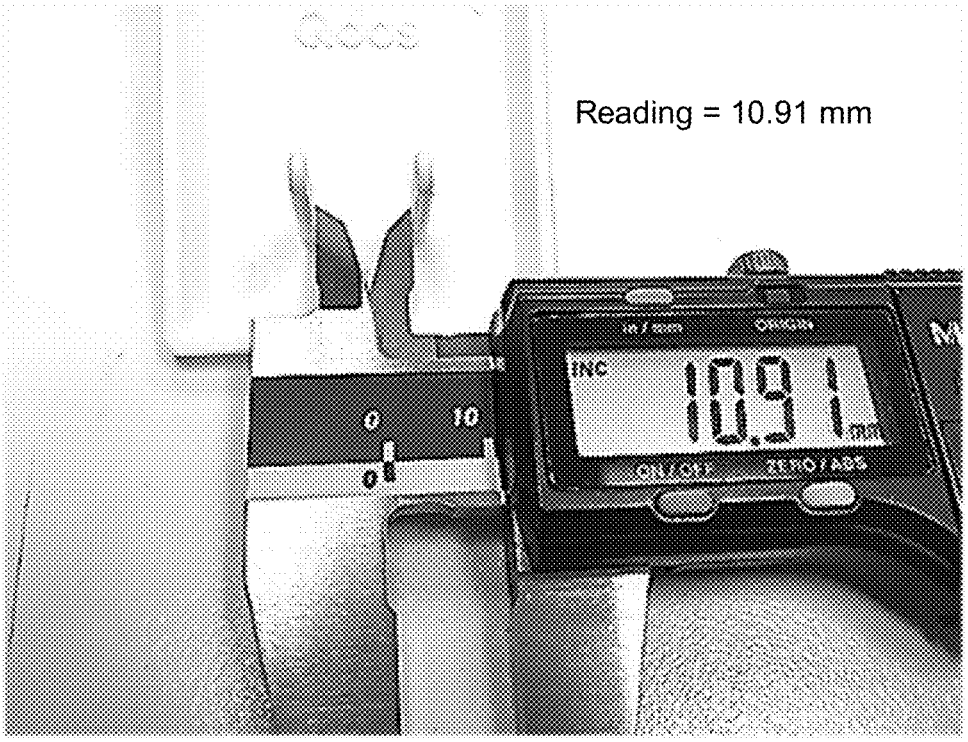
Figure 3E:
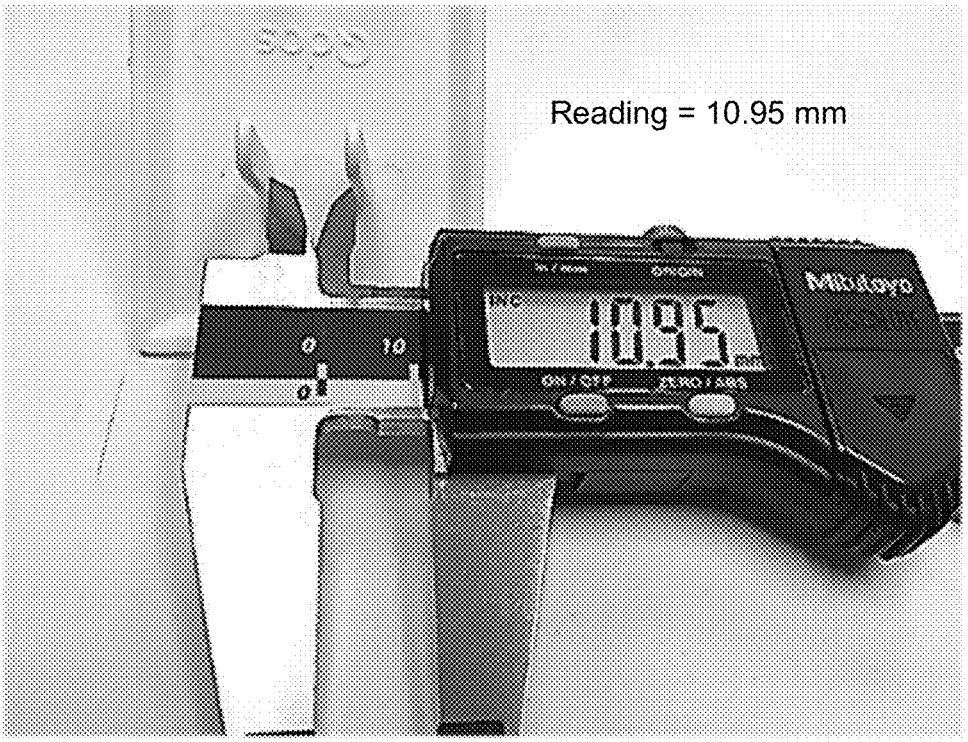

The first pair of prongs 103*a* can be separated from the second pair of prongs 103*b* by a distance in a range from about 34 mm to about 36 mm, from about 34.5 mm to about 35.5 mm, or from about 34.8 mm to about 35.0 mm. In the example of FIG. 3C, the distance between the first and second pairs of prongs 103*a* and 103*b* is about 34.9 mm. The spacing between each pair of the prongs 103 is approximately the same, such as in a range from about 10.9 mm to about 11.0 mm. In the example shown in FIGS. 3D and 3E, the spacing between the prongs of the first pair 103*a* is about 10.9 mm and between the prongs of the second pair 103*b* is about 10.95 mm.

Figure 4A:
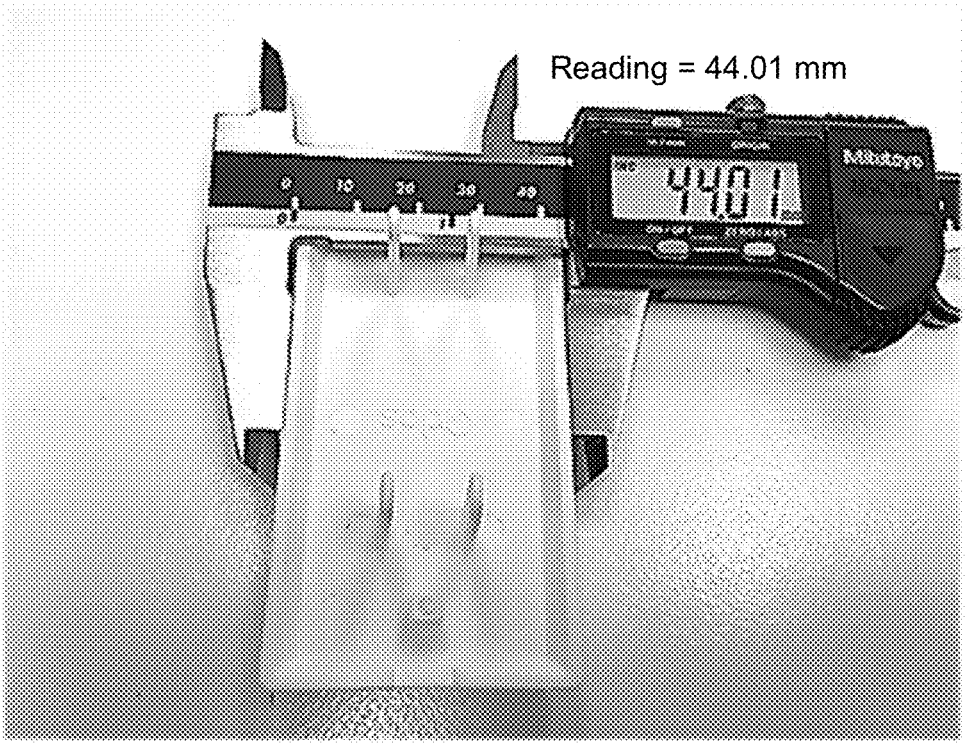
FIGS. 4A and 4B are images illustrating an example of the width and height or length of the outlet safety cover plate of FIG. 1, in accordance with various embodiments of the present disclosure.
Figure 4B:
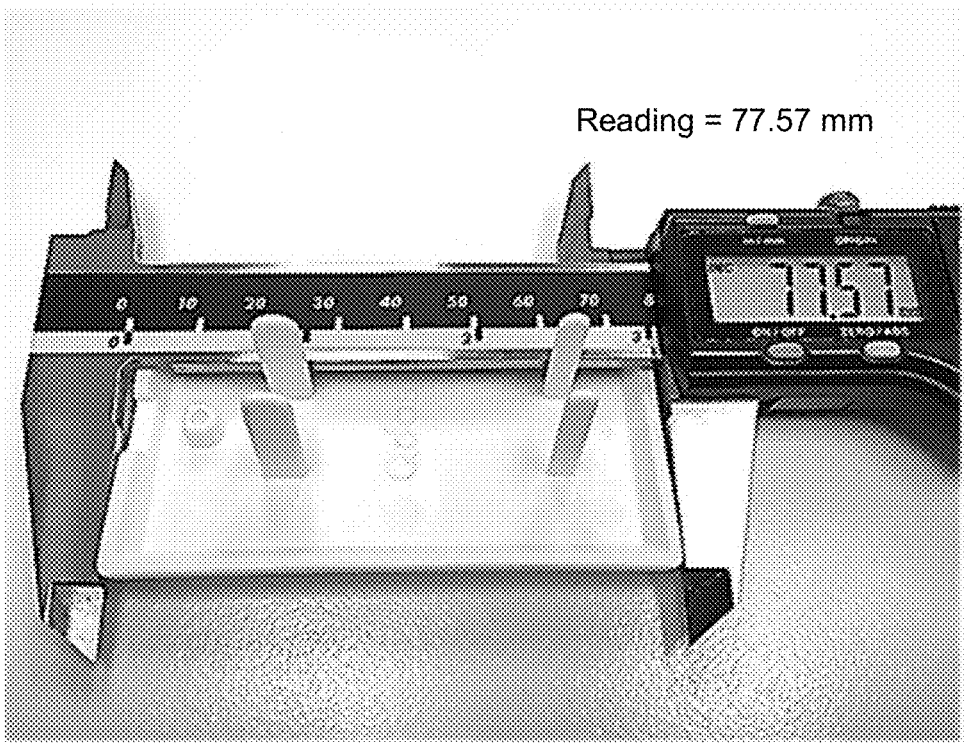

The outlet safety cover plate 100 can be designed to fit over an electrical outlet and cover a portion of the wall plate secured over the outlet. The outlet safety cover plate 100 can include rounded edges that can be disposed against the surface of the electrical outlet wall plate. The front face and the sides of the outlet safety cover plate 100 that are in view can be painted, wall papered, or otherwise designed as desired by the user, often in a manner similar to the surrounding wall or wall plate. FIGS. 4A and 4B illustrate an example of the outer dimensions of the cover 106 of the outlet safety cover plate 100. The width of the cover 106 can be in a range from about 40 mm to about 50 mm, from about 42 mm to about 46 mm, or from about 43 mm to about 45 mm. In the example of FIG. 4A, the width is about 44 mm. The length or height of the cover 106 can be in a range from about 65 mm to about 90 mm, from about 70 mm to about 85 mm, or from about 75 mm to about 80 mm. In FIG. 4B, the height is about 77.6 mm.

As can be seen in FIGS. 4A and 4B, the rear side of the cover 106 includes an inner area that is recessed. This allows edges of the outlet safety cover plate 100 to press against the wall plate even if the electrical outlet extends beyond the face of the wall plate. As shown in FIG. 1, a notch 112 can be included along one or more sides of the outlet safety cover plate 100 to facilitate removal of the outlet safety cover plate 100 after been engaged with the electrical outlet. In the example of FIG. 1, the notch 112 is located along a bottom edge of the cover 106 adjacent to the ground alignment post 109. The notch 112 extends upward and inward from the bottom of a rounded edge of the cover 106.

Figure 5A:
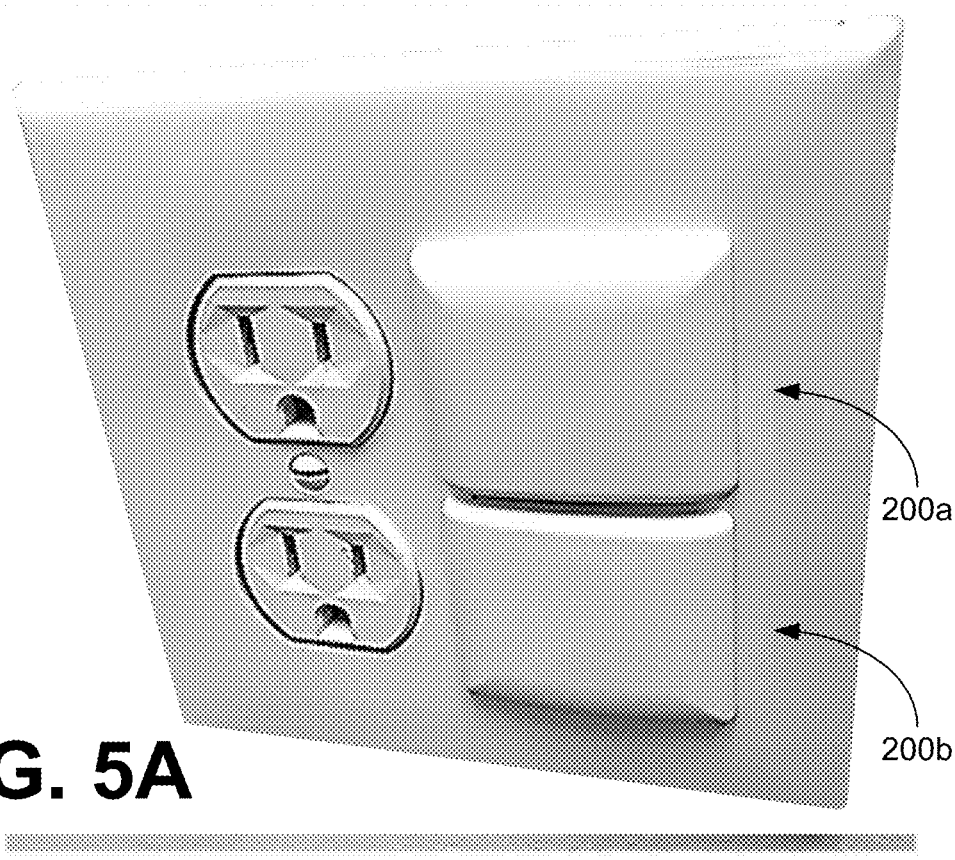
FIGS. 5A-5F are images illustrating an example of outlet safety cover plates for covering single sockets of an electrical wall outlet, in accordance with various embodiments of the present disclosure.

Referring next to FIG. 5A, shown in an example of outlet safety cover plates 200, which can individually cover a single socket of an electrical outlet, or can be matched to cover both sockets of the electrical outlet. The outlet safety cover plates 200 can include a top (or upper) cover plate 200*a* and a bottom (or lower) cover plate 200*b*. The outlet safety cover plates 200 are rectangular with curved edges similar to those illustrated in FIG. 1. The curved edges close the gap all the way down to the electrical outlet wall plate when installed in an outlet socket as shown in FIG. 5A. This design of the outlet safety cover plates 200 can prevent a child from grabbing the outlet safety cover plate 200 and exposing the electrical outlet.

Figure 5B:
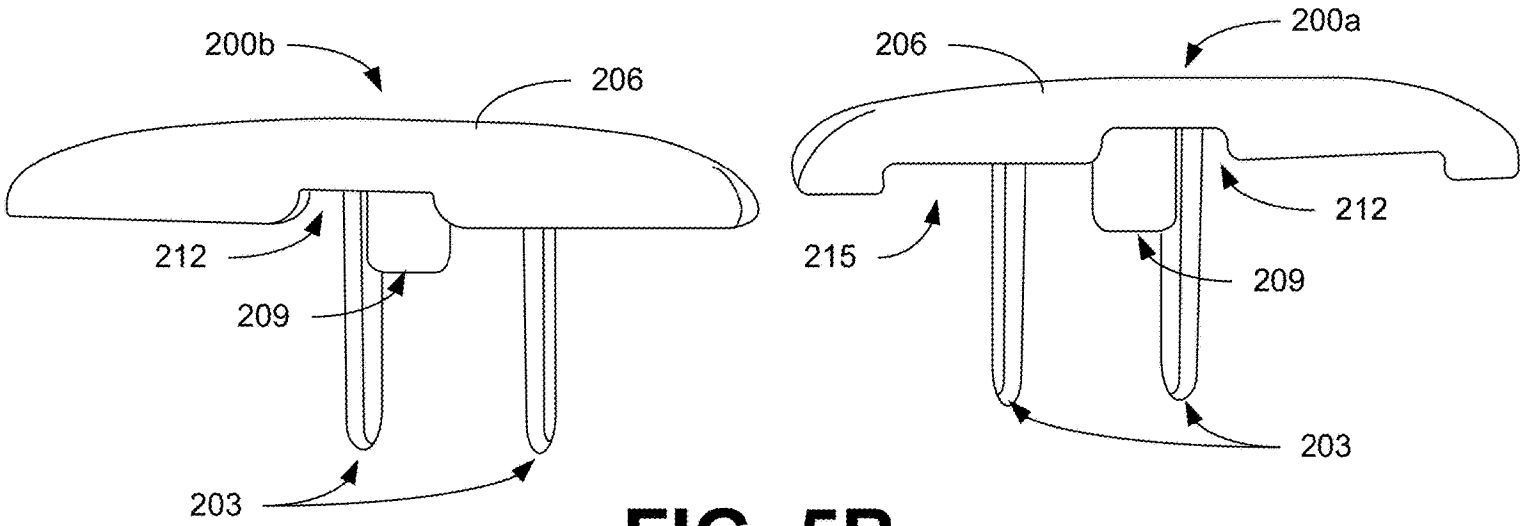
Figure 5C:
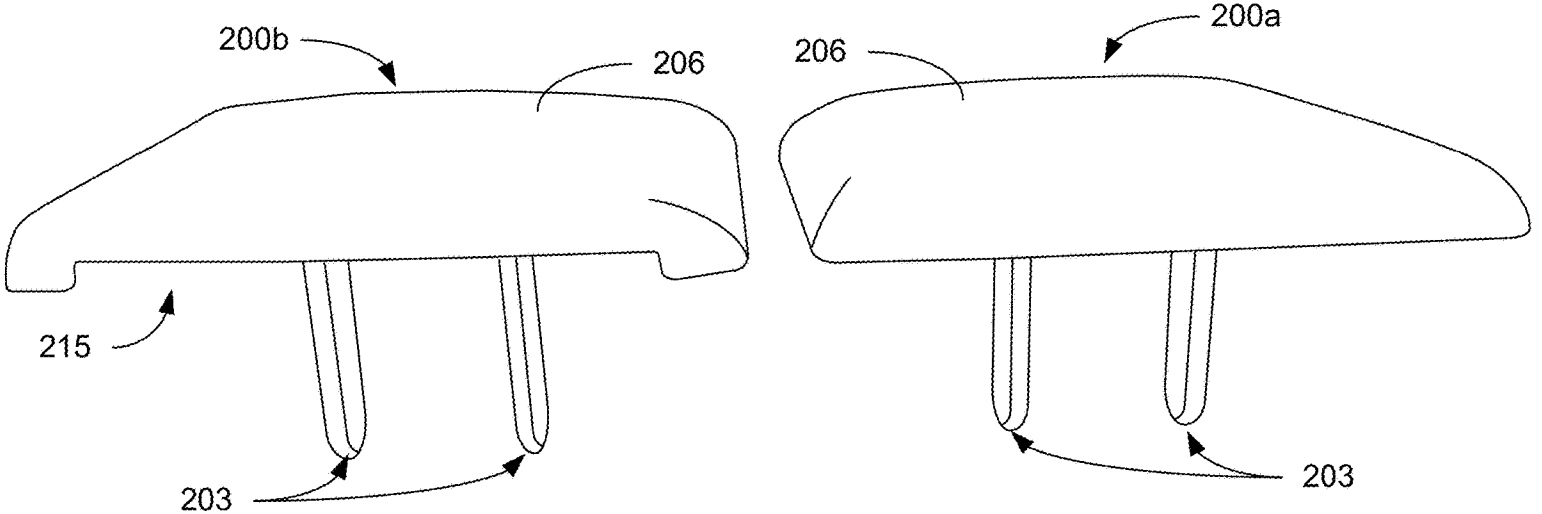

FIG. 5B shows a top view of the top cover plate 200*a* and the bottom cover plate 200*b*, and FIG. 5C shows a bottom view of the top cover plate 200*a* and the bottom cover plate 200*b*. Each outlet safety cover plate 200 can include prongs 203 disposed on a rear side of a cover 206 of the outlet safety cover plate 200, that are sized and spaced to engage electrical contact openings of conventional and GFCI electrical outlets. A pair of prongs 203 can be located on the rear side of the cover 206 of the outlet safety cover plate 200*a* or 200*b*. In addition, a ground alignment post 209 can be located between the pair of prongs 203 and a bottom edge of the cover 206 as shown in FIG. 5B. The ground alignment post 209 can be approximately aligned with a center point between the prongs of the pair of prongs 203 or approximately centered between opposite sides of the cover 206. The shape of the ground alignment post 209 corresponds to the shape of a grounding contact opening in the electrical outlet. When inserted into an electrical outlet, the ground alignment post 209 engages with the grounding contact opening to align and secure the outlet safety cover plate 200 in position.

The dimensions of the prongs 203 and ground alignment post 209 can be the same as that illustrated in FIGS. 3A-3E. The width of the cover 206 can be in a range from about 40 mm to about 50 mm, from about 42 mm to about 46 mm, or from about 43 mm to about 45 mm. The length or height of the cover 206 can be in a range from about 32 mm to about 45 mm, from about 35 mm to about 42 mm, or from about 37 mm to about 40 mm.

Figure 5E:
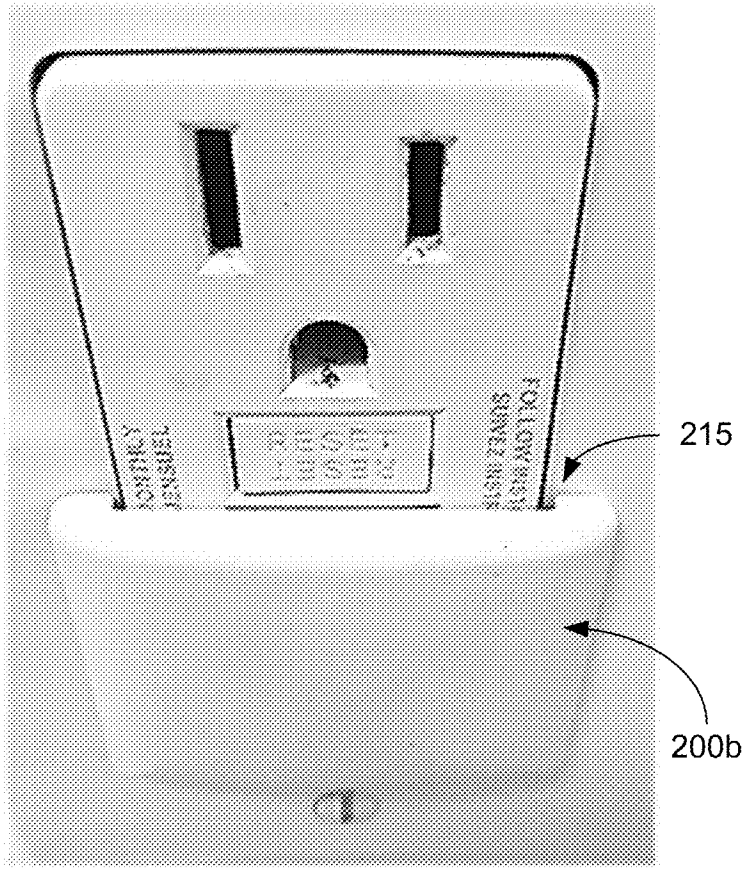
Figure 5D:
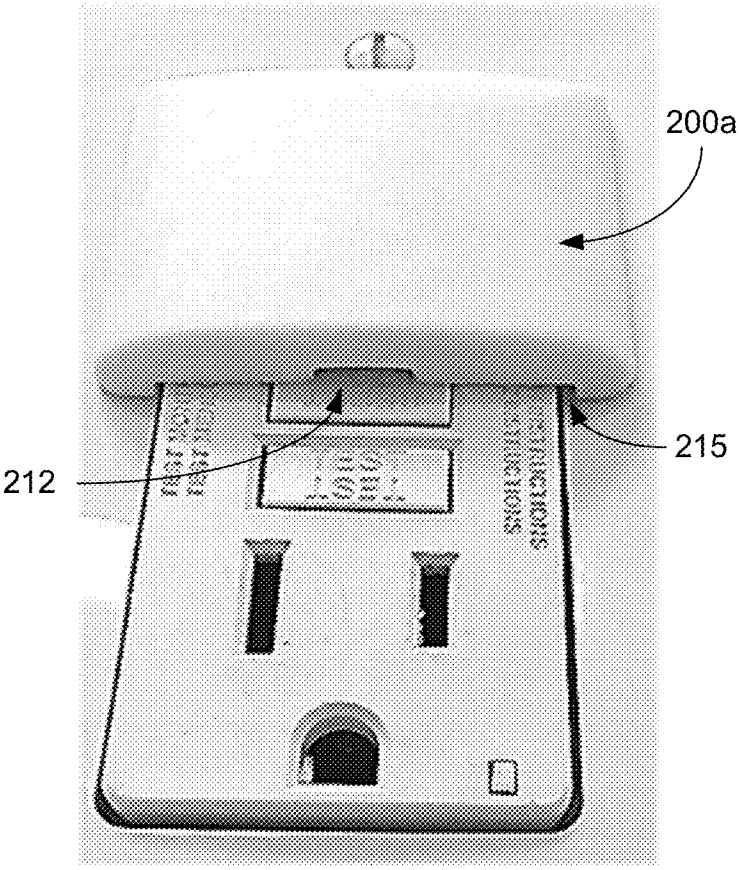

The rear side of the cover 206 includes an inner area that is recessed to allow the edges of the cover 206 to extend over the electrical wall outlet and make contact with the face of the outlet wall plate. This allows edges of the outlet safety cover plate 200 to press against the wall plate even if the electrical outlet extends beyond the face of the wall plate. FIGS. 5D and 5E are images shown the top and bottom outlet safety cover plates 200*a* and 200*b*, respectively, secured over a GFCI outlet. As illustrated in FIGS. 5D and 5E, the top (or upper) outlet safety cover plate 200*a* can include an outlet recess 215 that extends across a bottom edge and the bottom (or lower) outlet safety cover plate 200*b* can include an outlet recess 215 that extends across a top edge, respectively. The outlet recesses 215 extend upward and inward from the edges of the cover plates 200 to allow the outlet safety cover plates 200*a* and 200*b* to be secured against the face of the wall plate when the electrical outlet extends outward beyond the face of the wall plate.

As shown in FIG. 5B, a notch 212 can be included the bottom side of the outlet safety cover plates 200 to facilitate removal of the outlet safety cover plate 200 after been engaged with the electrical outlet. In the examples of FIG. 5B, a notch 212 can be located along a bottom edge of the cover 206 adjacent to the ground alignment post 209. In the bottom (or lower) outlet safety cover plate 200*b*, the notch 212 extends upward and inward from the bottom of the rounded edge at the bottom of the cover 206. In the top (or upper) outlet safety cover plate 200*a*, the notch 212 can extend upward and inward from the center of the outlet recess 215 as illustrated in FIGS. 5B and 5D. In the top (or upper) outlet safety cover plate 200*a*, the upper (or top) edge of the cover 206 does not include a notch or recess as seen in FIG. 5C.

Figure 5F:
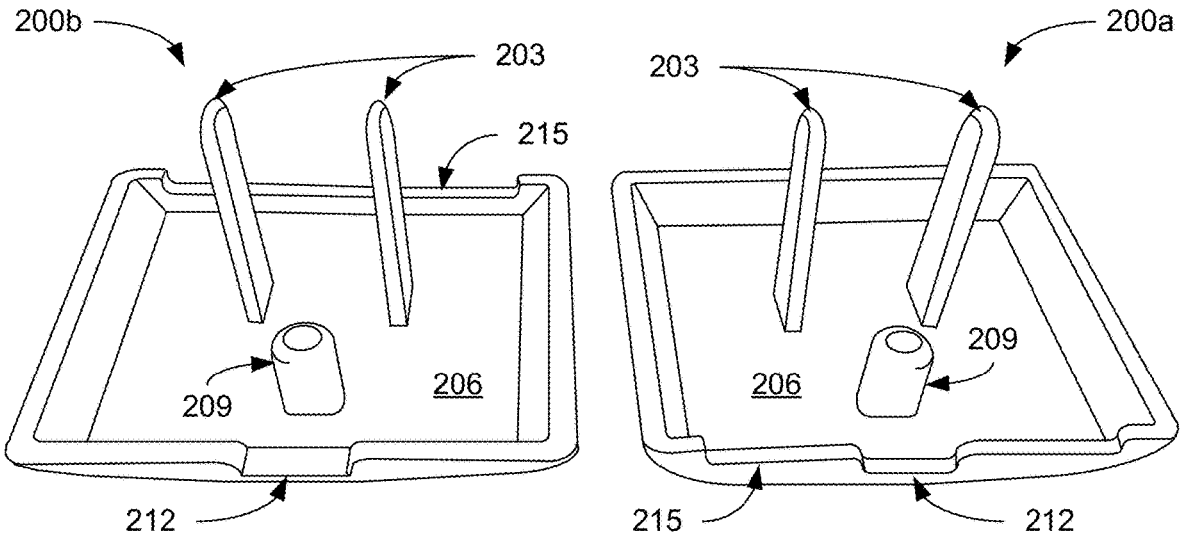

When installed in the sockets of the electrical wall outlet, the outlet recesses 215 can align with each other. The rounded outer edges of the outlet safety cover plates 200 can be curved to match the curve on the edges of the wall plate. As can be seen in FIGS. 5A-5C, the upper edge of the bottom outlet safety cover plate 200*b* and the lower (or bottom) edge of the top outlet safety cover plate 200*a* are substantially parallel with each other (and substantially perpendicular to the wall plate) when mounted in the electrical wall outlet. FIG. 5F shows the rear side of the cover 206 for the bottom and top outlet safety cover plates 200*b* and 200*a*, respectively. The rounded edges form a recessed area on the rear side of the cover 206 to allow the outlet safety cover plates 200 to press against the surface of the wall plate when installed in the sockets of the electrical outlet. The shape of the ground alignment post 209 corresponds to the shape of a grounding contact opening in the electrical outlet. When inserted into an electrical outlet, the ground alignment post 209 engages with the grounding contact opening to align and secure the outlet safety cover plate 200 in position.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a range of "about 33 mm to about 37 mm" should be interpreted to include not only the explicitly recited measurement of about 33 mm to about 37 mm, but also include individual measurements (e.g., 34 mm, 35 mm, and 36 mm) and the sub-ranges (e.g., 33.5 mm, 34.4 mm, 35.5 mm, and 36.6 mm) within the indicated range. The term "about" can include traditional rounding according to significant figures of numerical values. In addition, the phrase "about 'x' to 'y'" includes "about 'x' to about 'y'".

Therefore, at least the following is claimed:

1. An outlet safety cover plate, comprising:

a cover having a front face and a rear side opposite the front face, the cover having a cover width and a cover height or length defined by four rearward curving edges forming a substantially planar contact edge about a recessed area in the rear side of the cover;

a first pair of prongs extending from the rear side of the cover, the first pair of prongs displaced from each other by a portion of the cover width and configured to fit into a first pair of contact openings in an electrical outlet;

a second pair of prongs extending from the rear side of the cover, the second pair of prongs displaced from each other by the portion of the cover width and aligned with the first pair of prongs along the cover height or length and configured to fit into a second pair of contact openings in the electrical outlet, where each of the first pair of prongs has a first prong width that is approximately two thirds of a second prong width of each of the second pair of prongs thereby allowing the first and second pairs of prongs to engage with the first and second pairs of contact openings in both conventional and GFCI outlets without adjustment or modification; and a single ground alignment post formed on the rear side of the cover in the recessed area, where the second pair of prongs are located between the first pair of prongs and a bottom rearward curving edge of the cover, and the single ground alignment post is located between the second pair of prongs and the bottom rearward curving edge of the cover; and where the cover, the first pair of prongs and the second pair of prongs are integrally made of a same material with the first pair of prongs and the second pair of prongs in fixed positions on the rear side of the cover and extending rearward beyond the substantially planar contact edge about the cover.

2. The outlet safety cover plate of claim 1, wherein the first prong width of the first pair of prongs is in a range from about 4.2 mm to about 4.4 mm and the second prong width of the second pair of prongs is in a range from about 6.3 mm to about 6.6 mm.

3. The outlet safety cover plate of claim 2, wherein the first prong width of the first pair of prongs is in a range from about 4.2 mm to about 4.35 mm and the second prong width of the second pair of prongs is in a range from about 6.4 mm to about 6.55 mm.

4. The outlet safety cover plate of claim 3, wherein the first prong width of the first pair of prongs is about 4.3 mm and the second prong width of the second pair of prongs is about 6.5 mm.

5. The outlet safety cover plate of claim 1, wherein a distance between the first pair of prongs and the second pair of prongs along the cover height or length is in a range from about 34.5 mm to about 35.5 mm.

6. The outlet safety cover plate of claim 5, wherein the distance between the first pair of prongs and the second pair of prongs is in a range from about 34.8 mm to about 35.0 mm.

7. The outlet safety cover plate of claim 6, wherein the distance between the first pair of prongs and the second pair of prongs is about 34.87 mm.

8. The outlet safety cover plate of claim 1, wherein the single ground alignment post is approximately centered across the cover width between opposite sides of the cover.

9. The outlet safety cover plate of claim 1, comprising a notch along the bottom rearward curving edge of the cover adjacent to the single ground alignment post.

10. The outlet safety cover plate of claim 1, comprising a notch centered along one of the four rearward curving edges of the cover, the notch extending partially into the one reward curving edge from the substantially planar contact edge.

11. The outlet safety cover plate of claim 1, wherein the cover width is in a range from about 42 mm to about 46 mm and the cover height or length is in a range from about 70 mm to about 85 mm.

12. The outlet safety cover plate of claim 1, wherein the cover width is in a range from about 43 mm to about 45 mm and the cover height or length is in a range from about 75 mm to about 80 mm.

13. The outlet safety cover plate of claim 1, wherein the cover width is about 44 mm and the cover height or length is about 77.6 mm.

14. An outlet safety cover plate, comprising:

a cover having a front face defined by a plurality of rounded edges curving rearward and a recessed rear side defined by the plurality of rounded edges, the plurality of rounded edges forming a substantially planar contact edge about the recessed rear side of the cover, the cover comprising:

a pair of prongs extending from the recessed rear side of the cover, the pair of prongs displaced from each other by a portion of a width of the cover and configured to fit into a pair of contact openings in an electrical outlet, the cover and the pair of prongs integrally made of a same material with the pair of prongs in a fixed position on the recessed rear side of the cover and extending rearward beyond the substantially planar contact edge about the cover;

a single ground alignment post located between the pair of prongs and a bottom edge of the cover, the single ground alignment post formed on the recessed rear side of the cover with the single ground alignment post approximately centered across the width and between opposite sides of the cover, the single ground alignment post configured to engage with a ground contact opening in the electrical outlet; and a notch in the bottom edge of the cover adjacent to the single ground alignment post.

15. The outlet safety cover plate of claim 14, wherein the cover further comprises an outlet recess extending across and centered in a top edge of the cover opposite the notch in the bottom rounded edge of the cover.

16. The outlet safety cover plate of claim 14, further comprising:

a second cover having a front face defined by a plurality of rounded edges curving rearward and a recessed rear side defined by the plurality of rounded edges, the plurality of rounded edges forming a substantially planar contact edge about the recessed rear side of the second cover, the second cover comprising:

a pair of prongs extending from the recessed rear side of the second cover, the pair of prongs configured to fit into a second pair of contact openings in the electrical outlet;

a ground alignment post located between the pair of prongs and a bottom edge of the second cover;

an outlet recess extending across and centered in the bottom edge of the second cover; and a notch in the outlet recess of the second cover adjacent to the ground alignment post.

17. The outlet safety cover plate of claim 16, wherein the cover further comprises an outlet recess extending across and centered in a top edge of the cover opposite the notch in the bottom edge of the cover, wherein the outlet recess of the cover aligns with the outlet recess of the second cover when both the cover and the second cover are installed in the electrical outlet.

18. The outlet safety cover plate of claim 17, wherein the top edge of the cover is substantially parallel with the bottom edge of the second cover when both covers are installed in the electrical outlet.

* * * * *